US011366485B1

(12) United States Patent
Domzalski et al.

(10) Patent No.: US 11,366,485 B1
(45) Date of Patent: Jun. 21, 2022

(54) MULTI-WAY INPUT DEVICE

(71) Applicant: C&K COMPONENTS S.A.S., Dole (FR)

(72) Inventors: Frank Domzalski, Wellesley, MA (US); Junbao Chen, Huizhou (CN); Fred Zhang, Huizhou (CN)

(73) Assignee: C&K COMPONENTS S.A.S., Dole (FR)

( * ) Notice: Subject to any disclaimer, the term of this patent is extended or adjusted under 35 U.S.C. 154(b) by 0 days.

(21) Appl. No.: 17/468,942

(22) Filed: Sep. 8, 2021

(51) Int. Cl.
*G05G 9/047* (2006.01)
*G05G 5/08* (2006.01)

(52) U.S. Cl.
CPC ..... *G05G 9/047* (2013.01); *G05G 5/08* (2013.01); *G05G 9/04796* (2013.01); *G05G 2009/04714* (2013.01); *G05G 2009/04751* (2013.01); *G05G 2009/04755* (2013.01); *G05G 2009/04774* (2013.01); *G05G 2009/04777* (2013.01)

(58) Field of Classification Search
CPC ..... G05G 9/047; G05G 2009/0414; G05G 2009/04755; G05G 2009/04774; G05G 2009/04777; G05G 2009/04796; G05G 2009/04751; G05G 2009/04744; G05G 5/08; H01H 25/065
See application file for complete search history.

(56) References Cited

U.S. PATENT DOCUMENTS 6,150,919 A * 11/2000 Shimomura ..... H01C 10/16 200/6 A
6,445,377 B1 9/2002 Shimomura
6,538,639 B1 * 3/2003 Takahashi ..... G05G 9/047 345/161
7,077,750 B1 * 7/2006 Nakamura ..... G05G 9/047 463/36
2001/0002127 A1 * 5/2001 Cheng ..... G05G 9/047 345/161
2002/0056621 A1 * 5/2002 Nakai ..... G05G 9/047 200/61.39
2002/0093524 A1 * 7/2002 Koike ..... A63F 13/40 715/701

(Continued)

FOREIGN PATENT DOCUMENTS

GB 2091423 A 7/1982

*Primary Examiner* — Daniel D Yabut
(74) *Attorney, Agent, or Firm* — Fox Rothschild LLP

(57) ABSTRACT

A multi-way input device includes a first interlocking member, a second interlocking member, a hollow frame within which the interlocking members are mounted, and an operating shaft inserted through both a slit of the first interlocking member and a slot of the second interlocking member. The device also includes first and second sensing components capable of being operated respectively through the first and second interlocking members when rotating by operation of the operating shaft, along with third sensing component capable of being operated through the second interlocking member when pivoting by operation of the operating shaft. The device also includes an articulation member that is rotatably supported by the hollow frame around an axis. The second interlocking member is supported by the articulation member to form a mobile unit that is rotatable. The second interlocking member is also pivotally mounted on the articulation member.

7 Claims, 5 Drawing Sheets

(56) References Cited

U.S. PATENT DOCUMENTS

| | | | | |
|---|---|---|---|---|
| 2002/0105498 | A1* | 8/2002 | Shimomura | G05G 9/047 345/161 |
| 2018/0174783 | A1* | 6/2018 | Wu | G05G 9/047 |
| 2018/0190452 | A1* | 7/2018 | Wu | H01H 25/04 |

* cited by examiner

MULTI-WAY INPUT DEVICE

BACKGROUND

1. Technical Field

The present invention relates to a multi-way input device capable of operating a plurality of sensing components by operation of an operating shaft.

2. Description of the Related Art

The invention relates to a multi-way input device of the type disclosed for example in U.S. Pat. No. 6,445,377. According to the teachings of this document, such a device comprises: a first interlocking member which has a longitudinal slit and which is rotatable; a second interlocking member disposed in a direction orthogonal to the longitudinal direction of said first interlocking member; said second interlocking member having a slot and being rotatable; a hollow frame within which said first and second interlocking member are mounted; said first interlocking member being rotatably supported by said hollow frame around a first geometrical axis; an operating shaft inserted through both said slit of the first interlocking member and said slot of the second interlocking member; wherein: said second interlocking member is rotatably mounted within said hollow frame around a second geometrical axis orthogonal to said first axis; said second interlocking member is pivotally mounted within said hollow frame around a third geometrical axis parallel to said first axis; said operating shaft is rotatably supported by the second interlocking member around a fourth geometrical axis; and comprising a first sensing component, or sensor, and a second sensing component (or sensor) attached to said hollow frame and capable of being operated respectively through said first and second interlocking members when rotating by operation of said operating shaft, and a third sensing, or switch, component attached to said hollow frame and capable of being operated through said second interlocking member when pivoting by operation of said operating shaft.

According to various examples, each sensing component is a resistor element.

The use of Hall effect sensors is already known from GB2091423 concerning a transducer device associated with a joystick control lever.

The third sensing component is an electric component such as a push-button switch.

When any operating force is not applied to the operating shaft, that is, the operating shaft assumes its vertical upright neutral under the biasing force of a return spring.

When an operating tilting force is applied to the operating shaft, the operating shaft tilts around the second axis and the second interlocking member rotates around the second axis and operates the second sensing element and the resistance value of the variable resistor changes.

When the operating force, which has been exerted on the operating shaft, is relieved, the operating member returns automatically to its neutral position or state because of the biasing force of the return spring.

When another operating tilting force is applied to the operating shaft, the operating shaft tilts in another orthogonal direction; the first interlocking member rotates around the first axis and operates the first sensing element and the resistance value of the variable resistor changes.

When the operating force, which has been exerted on the operating shaft, is relieved, the operating member reverts to its neutral position automatically because of the biasing force of the return spring.

For operating the push-button switch, a globally vertical downward switching force or load is applied to the operating shaft to push the operating shaft downwardly along its general vertical orientation.

As a result, a lateral arm portion of the second interlocking member moves globally vertically with the operating shaft 40 and pushes the stem portion of the push-button switch. In this way, the push-button switch can be turned ON and OFF.

The operating shaft can be pushed in a direction along its general axis not only when the operating shaft is in its neutral angular state but also after tilting of the operating shaft and after attainment of a predetermined resistance value of the variable resistor.

In the above conventional multi-way input devices, however, the switch actuating force applied to the operating shaft may not be sufficiently precise to activate the switch for the control of selection functions.

Furthermore, the switching actuation force may have an impact on the angular position of the potentiometer or on the Hall effect sensor magnets.

SUMMARY

It is an object of the present invention to solve the above-mentioned problems and provide a multi-way input device superior in efficiency and precision and low in cost.

According to the first arrangement adopted by the present invention for solving the foregoing problems there is provided a multi-way input device comprising a first interlocking member which has a longitudinal slit and which is rotatable; a second interlocking member disposed in a direction orthogonal to the longitudinal direction of said first interlocking member, said second interlocking member having a slot and being rotatable; a hollow frame within which said first and second interlocking member are mounted, said first interlocking member being rotatably supported by said hollow frame around a first axis; an operating shaft inserted through both said slit of the first interlocking member and said slot of the second interlocking member; wherein: said second interlocking member is rotatably mounted within said hollow frame around a second axis orthogonal to said first axis, said second interlocking member is pivotally mounted within said hollow frame around a third axis parallel to said first axis, and said operating shaft is rotatably supported by the second interlocking member around a fourth axis; and comprising a first (magnetic) sensing component and a second sensing component arranged with respect to said hollow frame and capable of being operated respectively through said first and second interlocking members when rotating by operation of said operating shaft, and a third sensing component attached to said hollow frame and capable of being operated through said second interlocking member when pivoting by operation of said operating shaft, characterized in that: said multi-way input device comprises an articulation member that is rotatably supported by said hollow frame around said second axis; said second interlocking member is supported by said articulation member to form a mobile unit that is rotatable around said second axis; and in that said second interlocking member is pivotally mounted on said articulation member around said third axis.

Said articulation member is a hollow member defining an internal cavity in which the second interlocking member is arranged.

Said first sensing component is a magnetic sensing component, and said second sensing component is a magnetic sensing component.

Said first sensing component is a Hall effect sensor, and said second sensing component is a Hall effect sensor.

The second interlocking member comprises a longitudinal end branch that is pivotally mounted, around said third axis, on an associated end branch of the articulation member, and comprises another opposed end branch that is actuating said third sensing component.

Said third sensing component is a push-button tact switch.

Said second interlocking member is mounted in the articulation member with a small free play, and in that an operating action on the operating shaft along its general axis does not provoke any rotation of the first interlocking member around the first axis, nor any rotation of the second interlocking member around the second axis.

BRIEF DESCRIPTION OF THE DRAWINGS

Further features and advantages of the invention will become apparent from the following detailed description, for the understanding of which reference is made to the attached drawings in which.

DETAILED DESCRIPTION

Figure 1:
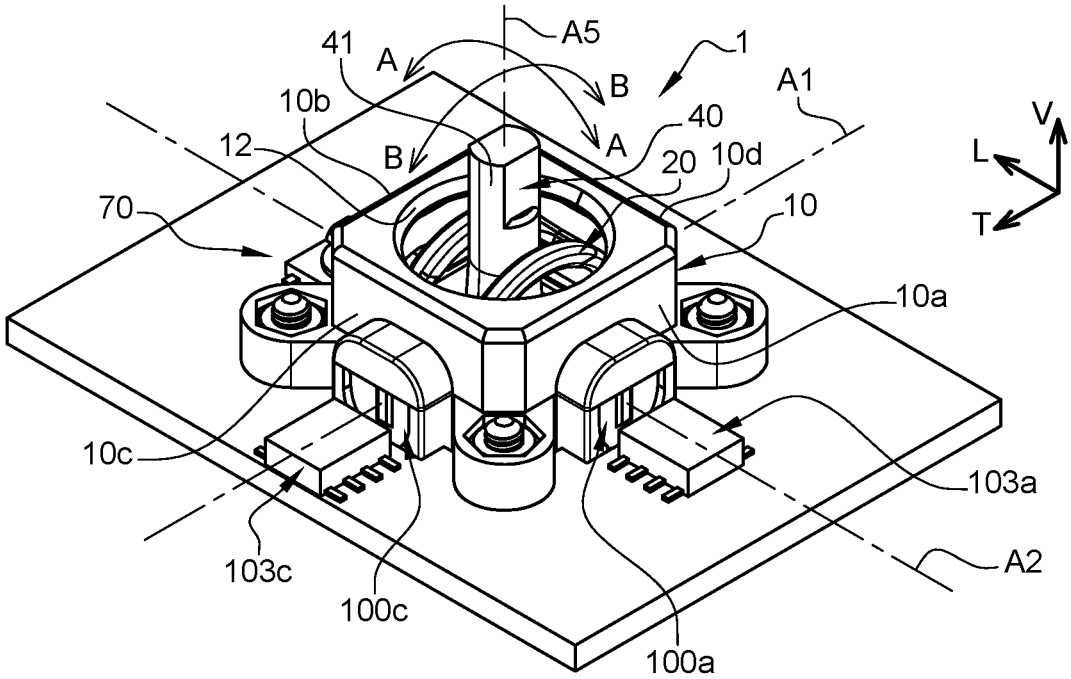
FIG. 1 is a perspective view of a multi-way input device embodying the present invention.
Figure 2:
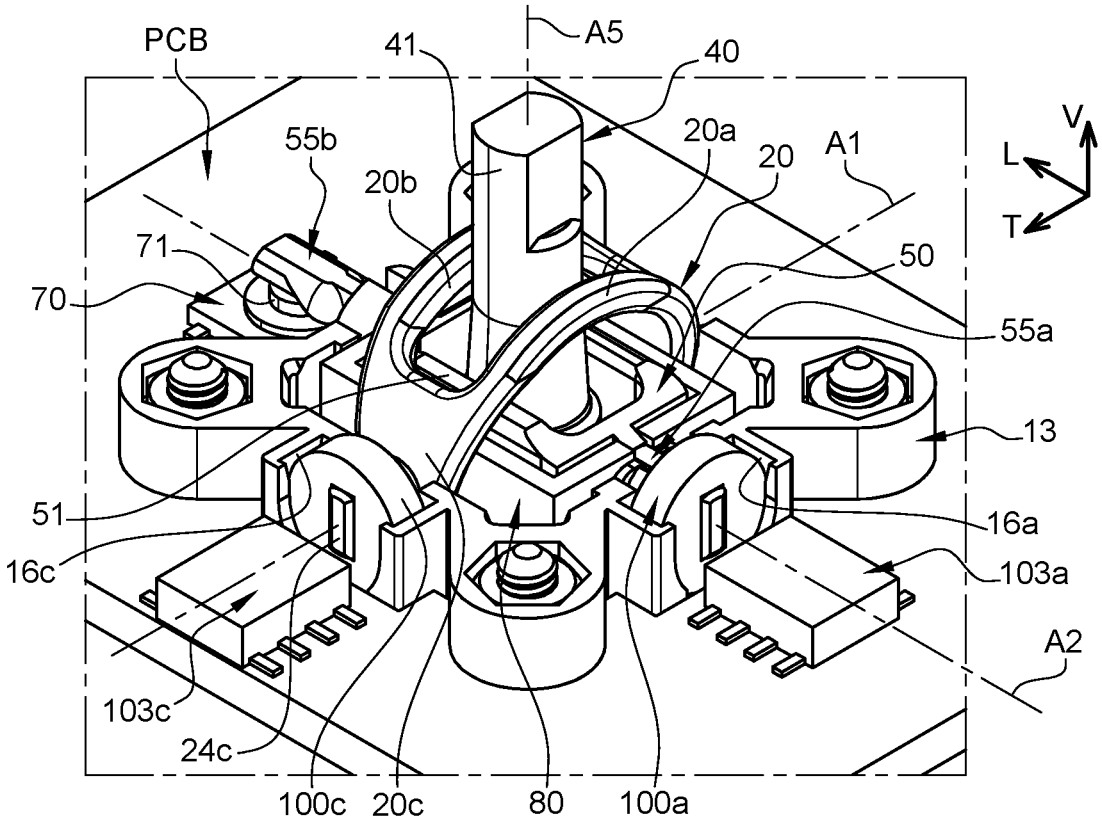
FIG. 2 is a perspective view the multi-way input device of FIG. 1 illustrated without the upper part of its hollow frame.

For the description of the invention and the understanding of the claims, the vertical, longitudinal and transverse orientations will be adopted, without reference to the earth's gravity, according to the reference V, L, T shown in the figures, whose longitudinal L and transverse T axes extend in a horizontal plane.

By convention, the longitudinal axis L is oriented from right to left, and the vertical axis V is oriented from bottom to top.

In the following description, identical, similar or analogous elements will be designated by the same reference numerals.

A multi-way input device 1 according to an embodiment of the present invention will be described hereunder with reference to FIGS. 1 to 8.

In the multi-way input device 1, as shown in FIGS. 1, 3, 4 and 6, a two parts hollow frame 10 is disposed that has vertical side walls or plates 10*a*, 10*b*, 10*c* and 10*d*. The hollow frame 10 comprises an upper part 11 and a lower part 13 and has a hollow interior. Its bottom is closed by the bottom wall 10*e* of its lower part 13. Its external form is generally in the shape of a rectangular parallelepiped. The top of the hollow frame 10 is closed by a horizontal top wall 10*f* of its upper part 11, with an operating hole 12 being formed centrally in the top wall 10*f*.

Four cylindrical support and guiding holes 14*a* to 14*d* are formed respectively in the four sidewalls 10*a*, to 10*d*. Two cylindrical apertures 16*c* and 16*a* for rotatably receiving magnetic components 100*c* and 100*a*, are formed in the sidewalls 10*a* and 10*c*.

Each aperture 16*c* and 16*a* is coaxial with and adjacent to an associated cylindrical hole 14*c* and 14*a* respectively.

In the side wall 10*b* opposed to the side wall 10*a* is formed a support and guiding cylindrical hole 14*b* that is coaxial with the opposed support and guiding cylindrical hole 14*a* formed in the side wall 10*a*.

In the side wall 10*d* opposed to the side wall 10*c* is formed a support and guiding cylindrical hole 14*d* that is coaxial with the opposed support and guiding cylindrical hole 14*c* formed in the side wall 10*c*.

At each one of the four angles of the upper part 11 of the hollow frame 10 is formed a leg 18 for mounting and clipping the upper part 11 on the complementary lower part 13.

A first interlocking member 20 is disposed within the hollow frame 10. The first interlocking member 20 is curved upward in an arch shape, and a slit 20*a* is formed transversally in this arcuate portion 20*b*.

Both lateral end portions 20*c* and 20*d* of the arcuate portion 20*b* of the first interlocking member 20 are bent downward.

Each lateral end portion 20*c*, 20*d* is provided with an associated transversally and outwardly projecting cylindrical supporting and guiding shaft 22*c*, 22*d*. Respectively, the supporting and guiding shaft 22*c*, 22*d* is rotatably received in an associated complementary cylindrical support and guiding hole 14*c*, 14*d*.

Thus, the first interlocking member 20 is supported by the hollow frame 10 and is rotatably mounted around a first transversal geometrical axis A1.

The supporting and guiding shaft 22*c* is provided with a prong 24*c* that is inserted into a rectangular hole 102*c* of an associated magnetic component 100*c* for rotatably driving it around the first transversal axis A1.

The multi-way input device 1 comprises a central operating shaft 40 of a generally cylindrical shape extending along a central geometrical axis A5. In its rest position illustrated at FIGS. 1 to 5, the operating shaft 40 extends vertically with its central axis A5 being orthogonal to the bottom wall 10*e* of the lower part 13 of the hollow frame 10.

The operating shaft 40 comprises an upper knob portion 41, a lower hollow cylindrical portion 42 and an intermediary connecting portion 43.

The knob portion 41 of the operating shaft 40 is inserted into the slit 20*a* of the first interlocking member 20. The knob portion 41 of the operating shaft 40 is movable along the slit 20*a*.

The lower hollow cylindrical portion 42 is comprised of a peripheral wall and its lower side open. In the interior of the cylindrical portion 42 is formed a hollow receptacle space 44 for receiving therein a generally coil-shaped compression return spring 90.

Figure 3:
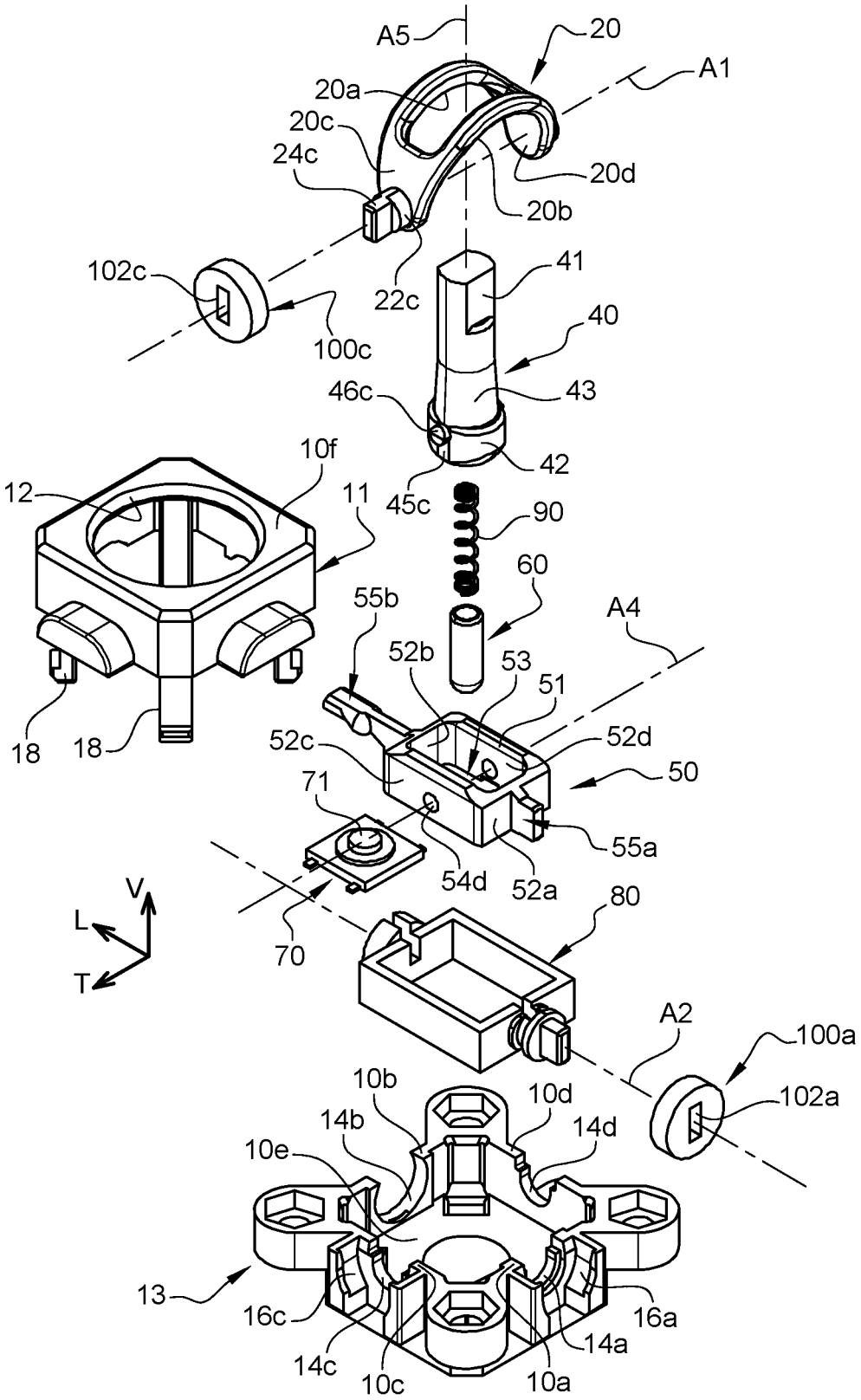
FIG. 3 is an exploded perspective view of the multi-way input device of FIG. 1 embodying the present invention.

As shown in FIG. 3, on the outer wall of the cylindrical portion 42 are formed two flat portions 45*c* and (45*d*) in an opposed relation to each other, and on part of a flat portions 45*c*, (45*d*) is respectively formed a cylindrical shaft portion 46*c*, (46*d*) at a predetermined diameter and height.

Both cylindrical shaft portions 46*c*, (46*d*) are coaxial and transversally opposed.

A hollow cylindrical operating member 60, which is movable in the axial direction of the operating shaft 40, is slidably disposed inside the hollow receptacle space 44 of the operating shaft 40.

The operating member 60 has a base portion 62 on its lower side, the base portion 62 having a spherical external form projecting vertically inside the hollow frame 10, toward the upper face of the bottom wall 10*e* of its lower part 13.

The biasing force of the return spring 90 permanently urges the operating member 60 downwardly into elastic contact with the upper face of the bottom wall 10*e*, whereby the operating shaft 40 can be returned to and held in its upright neutral state.

Figure 5:
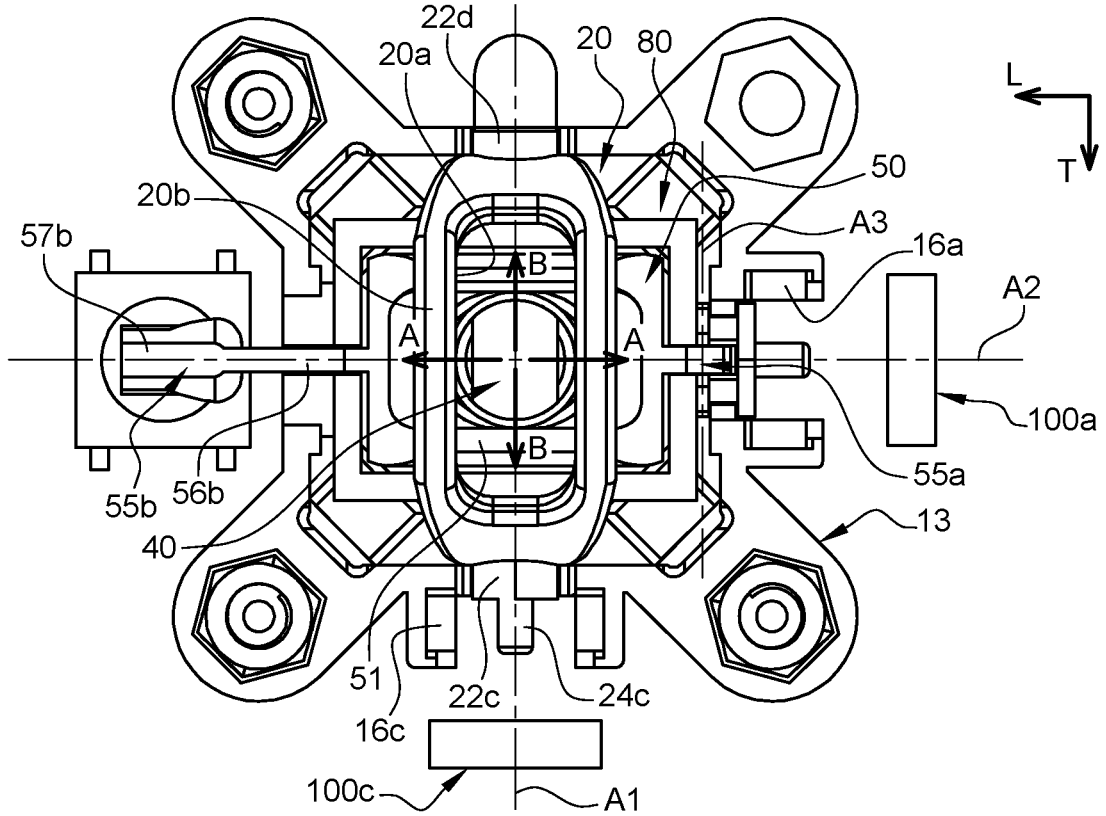
FIG. 5 is a top view of some of the components of the of the multi-way input device of FIG. 1, with some components that are exploded.
Figure 6:
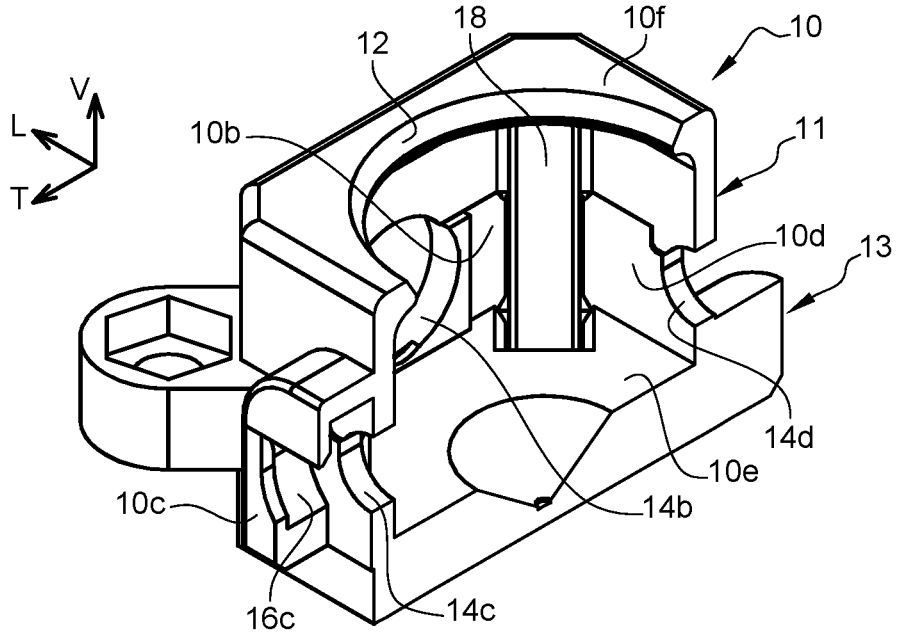
FIG. 6 is a sectional view of the two parts of the hollow frame of the multi-way input device of FIG. 1 through a vertical and transversal median plane.

The operating shaft 40 allows its shaft portions 46*c* and 46*d* to be supported by a second interlocking member 50 and can thereby tilt in both arrow A-A and B-B directions as shown in FIGS. 1 and 5.

The second interlocking member 50 is disposed below the first interlocking member 20 and extends in a longitudinal direction that is orthogonal to the general transversal direction of the first interlocking member 20.

Figure 7:
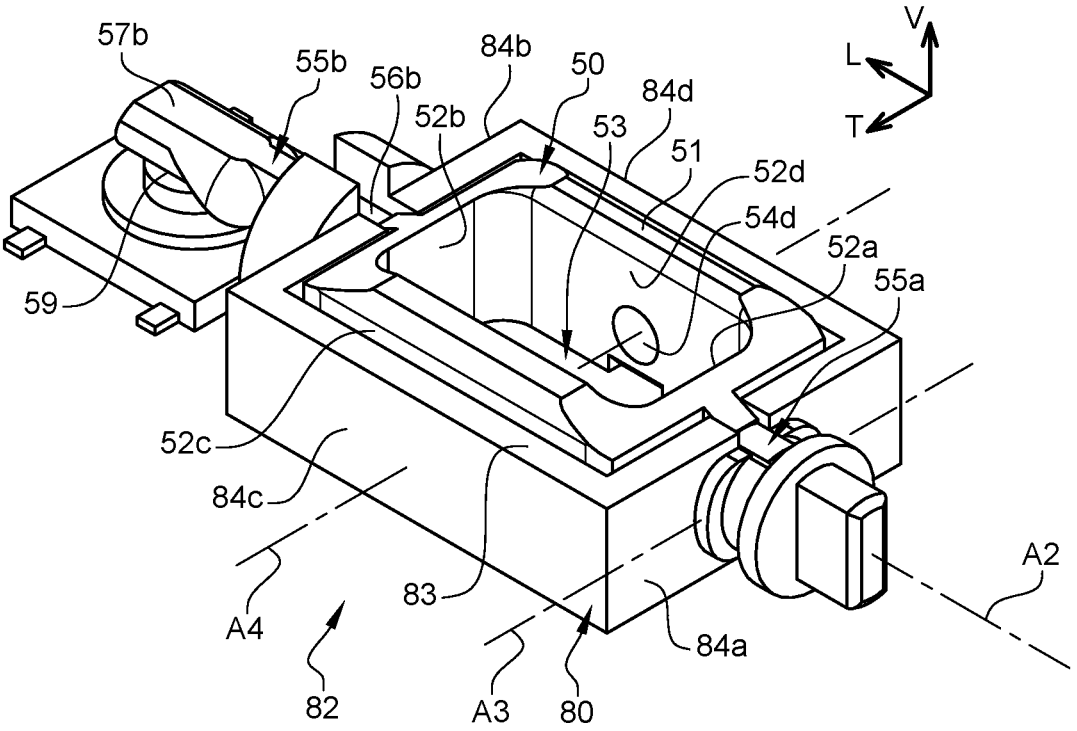
FIG. 7 is a perspective view of the second interlocking supported by the articulation member to form the mobile unit t of the multi-way input device of FIG. 1 hat is rotatable around said second axis.
Figure 8:
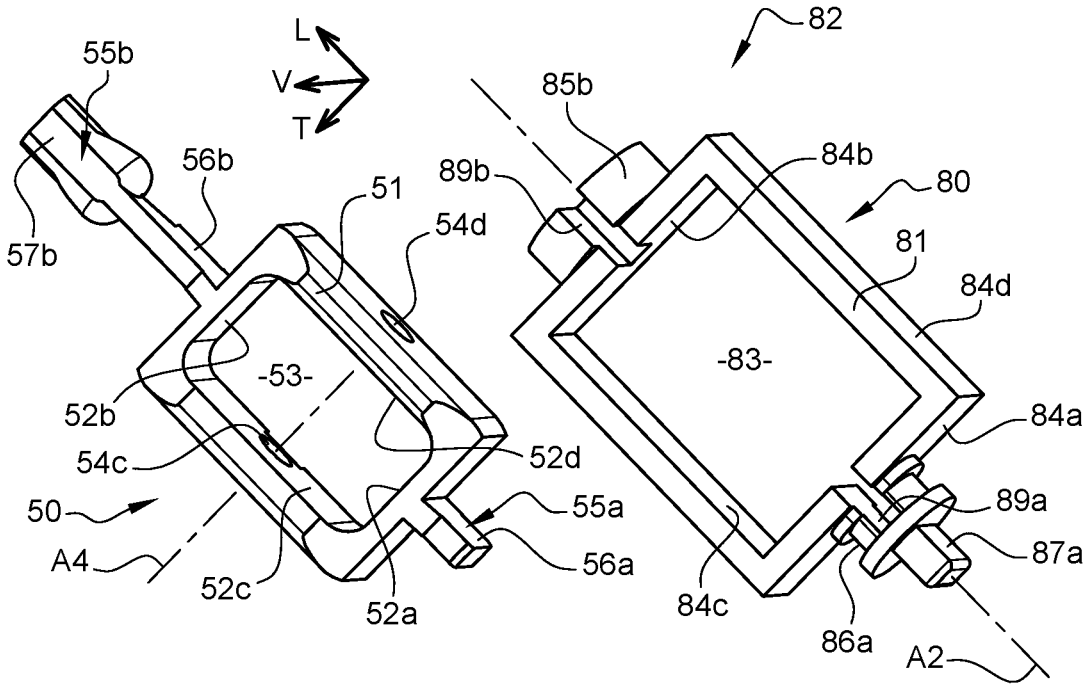
FIG. 8 is an exploded perspective view of the second interlocking member and the articulation member constituting the mobile ratable unit of the multi-way input device of FIG. 1.

As shown in FIGS. 3, 5 and 7, a support portion 51 of a generally rectangular shape is formed nearly centrally of the second interlocking member 50. The support portion 51 comprises long side vertical walls 52*c* and 52*d* and short vertical sidewalls 52*a* and 52*b* defining an inside space through which is formed an opening or slot 53 of a generally rectangular shape.

A pair of axially aligned opposed cylindrical holes 54*c* and 54*d* for respective engagement with the pivot shafts cylindrical shaft portion 46*c*, 46*d* of the operating shaft 40 are formed in predetermined positions of the long sidewalls 52*c* and 52*d* of the support portion s.

As shown in FIGS. 2 to 5 and 7, first 55*a* and second 55*b* branch portions extend longitudinally left and right from the central support portion 51.

The first branch portion 55*a* extending on one side is formed of a thin plate 56*a* extending centrally and longitudinally in a vertical plane.

The second branch portion 55*b* extending on the other side is formed firstly with a thin plate portion 56*b* extending centrally and longitudinally in a vertical plane, and secondly by a cylindrical end portion 57*b* that is component operating portion 57*b* having a horizontal flat lower actuating surface 59, extends longitudinally and horizontally from the support portion 51.

The component-operating portion 57*b* of the second branch portion 55*b* is positioned on a stem portion 71 of an electric component such as a push-button switch 70 that is here attached to printed circuit board PCB also supporting the multi-way device 1.

For example, the push-button switch 70 is a tactile switch of the normally opened NO type.

Apart from the multi-way input device 1 and the switch 70, the printed circuit board PCB is also supporting two Hall effect sensors 103*a* and 103*c*.

Figure 4:
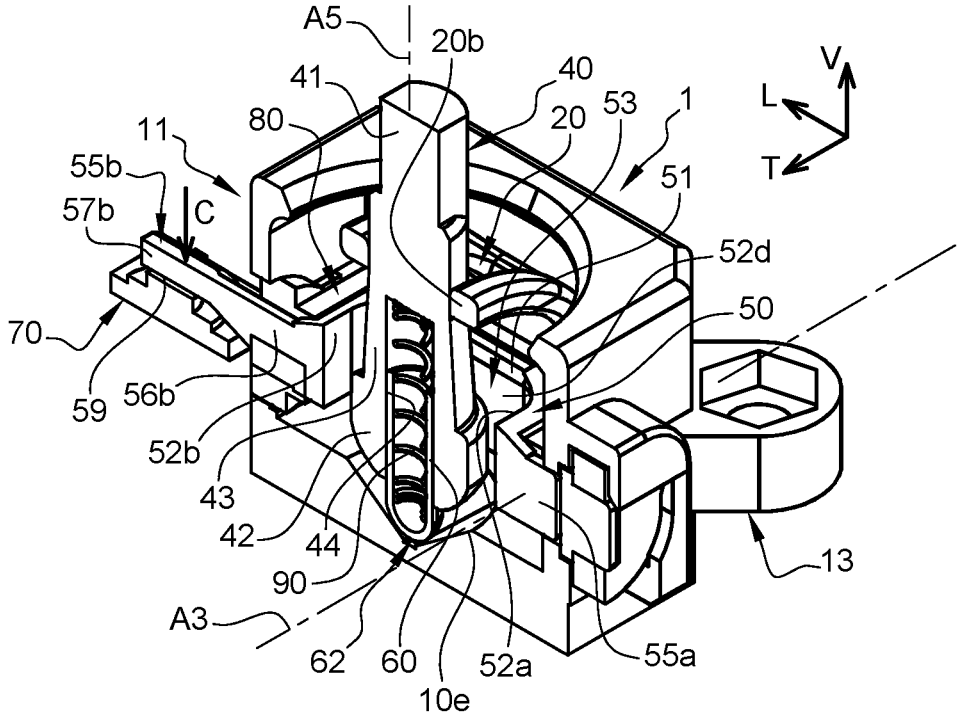
FIG. 4 is a sectional view of the multi-way input device of FIG. 1 through a vertical and longitudinal median plane.

For operating the push-button switch 70, a downward load is indirectly applied in an arrow C direction to the operating portion, as shown in FIG. 4, to push on the stem portion 71.

This load is applied indirectly by means of the operating shaft 40 that is rotatably supported by the second interlocking member 50 around the transversal and horizontal geometrical axis A4.

To this end, the second interlocking member 50 is pivotally mounted with respect to the hollow frame 10 around a horizontal and transversal geometrical axis A3 that is transversely passing through the first branch portion 55*a* formed of a thin plate 56*a* extending centrally and longitudinally in a vertical plane.

Thus, when pushing downward on the knob portion 41 of the operating shaft 40, the second interlocking member 50 pivots globally around the axis A3 in an anticlockwise direction when considering FIG. 4 so that the component operating portion 57*b* moves downwardly, substantially vertically.

The operating shaft 40 is permanently urged upwardly by the spring 70 and is retained upwardly in its rest position by its mounting on the support portion 51 of the second interlocking member 50.

The upward rest position of the second interlocking member 50 is defined by the second branch portion 56*b*, passing through the slot-shaped housing 89*b*, that cooperates with the facing portion of the upper part 11 of the hollow frame 10, and by the first branch portion 55*a*, 56*a* that is articulated on the articulation member 80, the latter cooperating with another facing portion of the upper part 11 of the hollow frame 10.

According to the invention, the multi-way input device 1 comprises an articulation member 80 that is rotatably supported by the hollow frame 10 around a geometrical axis A2 that is longitudinal and horizontal, and the second interlocking member 50 is supported by said articulation member 80 to form a mobile unit 82 that is rotatable around the second axis A2.

Additionally, the second interlocking member 50 is pivotally mounted on said articulation member around a third geometrical axis A3 that is parallel to said first axis A1.

As illustrated in FIGS. 2 to 5 and 7, the articulation member 80, is disposed around the second interlocking member 50 and extends in a longitudinal direction that is orthogonal to the general transversal direction of the first interlocking member 20.

A support portion 81—surrounding the support portion 51 of the second interlocking member 50—of a generally rectangular shape is formed nearly centrally of the articulation member 80. The support portion 81 comprises long side vertical walls 84*c* and 84*d* and short vertical sidewalls 84*a* and 84*b* defining an internal cavity 83 in which the support portion 51 of the second interlocking member 50 is arranged.

First 85*a* and second 85*b* branch portions extend longitudinally right and left from the central support portion 81.

The second branch portion 85*b* is a longitudinally outwardly projecting cylindrical supporting and guiding shaft that is rotatably received in the associated complementary cylindrical support and guiding hole 14*b* of the hollow frame 10.

In its upper portion, the supporting and guiding shaft 85*b*, as well as the upper portion of the short vertical sidewalls 84*b*, is slotted to define a vertical and longitudinal slot-shaped housing 89*b* that receives, with a slight clearance, the thin plate portion 56*b* of the second 55*b* branch portion of the second interlocking member 50.

The first branch portion 85*a* extending on the other side is formed firstly with a cylindrical portion 86*a* extending centrally and longitudinally, and secondly by a prong 87*a* that is inserted into a rectangular hole 102*a* of an associated magnetic component 100*c* for rotatably driving it around the longitudinal axis A2.

The portion 86*a* is an outwardly projecting cylindrical supporting and guiding shaft 86*a* that is rotatably received in the associated complementary cylindrical support and guiding hole 14*a* of the hollow frame 10.

By means of the shafts 86*a* and 85*b*, the articulation member 80 is rotatably supported by the hollow frame 10 for rotating around the second longitudinal axis A2.

The supporting and guiding shaft 86*a*, as well as the upper portion of the short vertical sidewalls 84*a* is slotted to define a vertical and longitudinal slot-shaped housing 89*a* that receives, with a slight clearance, the thin plate portion 56*a* of the second branch 55*a* of the second interlocking member 50.

Thus, the articulation member 80 is received with a free play in the second interlocking member 50 and is movable in a median vertical and longitudinal plane with respect to the second interlocking member 50, due to the guiding of the thin plate portion 56*b* in the slot-shaped housing 89*b* and of the first branch portion 55*a* in the slot shaped-housing 89*a*.

Due to the location of the central support portion 81 inside the central support portion 83, the operating shaft 40 is inserted through said slit 20*a* of the first interlocking member 20, the slot 53 of the second interlocking member 50, and the cavity 83 of the articulation member.

When the operating shaft 40 is tilted along arrows B, the second articulation member 50 drives the articulation member 80 and the magnetic component 100*a* for rotatably driving it around the longitudinal axis A2.

According to the invention, the right end or extremity of the second interlocking member 50 is pivotally mounted with respect to the right end or extremity of the articulation member 80 around a geometrical pivotal axis A3.

The pivot mounting of the first branch portion 55*a*, 56*a* in the slot-shaped housing 89*a* of the supporting and guiding shaft 86*a* is not illustrated in detail on the drawings.

For example, a transversal stem is inserted through corresponding aligned through holes formed in the thin plate portion 56*a* of the second branch 55*a* of the second interlocking member 50 and formed through the supporting and guiding shaft 86*a* of the second articulation member 80.

According to another example, complementary means can be made by moldings on both components and snap fitted during the assembly of the two components 50 and 80.

After the pivotal assembly of the second interlocking member 50 in the articulation member 80, these two components make a mobile unit that is rotatably mounted with respect to the hollow frame 10, around the geometrical longitudinal axis A2.

Due to the large longitudinal offset between the geometrical axis and the functional portion of the actuating surface 59 cooperating with the stem 71 of the switch 70, any slight angular pivotal of the second interlocking member around the axis A3 does correspond to a slight linear and vertical displacement of the actuating surface with respect to the stem 71 of the switch 70.

Due to the mounting of the articulation member 80 with a small free play in the second interlocking member 50, a selection or validation action on the operating shaft 40 along its general axis A5 is smooth and easy and does not provoke any parasite rotation displacement around the transversal and/or longitudinal axis A1 and/or A2.

What is claimed is:

1. A multi-way input device comprising:

a first interlocking member which has a longitudinal slit and which is rotatable;

a second interlocking member disposed in a direction orthogonal to the longitudinal direction of said first interlocking member; said second interlocking member having a slot and being rotatable;

a hollow frame within which said first interlocking member and second interlocking member are mounted; said first interlocking member being rotatably supported by said hollow frame around a first axis;

an operating shaft inserted through both said slit of the first interlocking member and said slot of the second interlocking member;

wherein:

said second interlocking member is rotatably mounted within said hollow frame around a second axis orthogonal to said first axis, said second interlocking member is pivotally mounted within said hollow frame around a third axis parallel to said first axis, said operating shaft is rotatably supported by the second interlocking member around a fourth axis;

and comprising a first sensing component and a second sensing component arranged with respect to said hollow frame and capable of being operated respectively through said first interlocking member and second interlocking member when rotating by operation of said operating shaft, and a third sensing component arranged with respect to said hollow frame and capable of being operated through said second interlocking member when pivoting by operation of said operating shaft, characterized in that:

said multi-way input device comprises an articulation member that is rotatably supported by said hollow frame around said second axis, said second interlocking member is supported by said articulation member to form a mobile unit that is rotatable around said second axis, and said second interlocking member is pivotally mounted on said articulation member around said third axis.

2. A multi-way input device according to claim 1, characterized in that said articulation member is a hollow member defining an internal cavity in which the second interlocking member is arranged.

3. A multi-way input device according to claim 1, characterized in that said first sensing component is a magnetic sensing component, and in that said second sensing component is a magnetic sensing component.

4. A multi-way input device according to claim 1, characterized in that said first sensing component is a Hall effect sensor, and in that said second sensing component is a Hall effect sensor.

5. A multi-way input device according to claim 1, characterized in that the second interlocking member comprises a longitudinal end branch that is pivotally mounted, around said third axis, on an associated end branch of the articulation member, and comprises another opposed end branch that is actuating said third sensing component.

6. A multi-way input device according to claim 5, characterized in that said third sensing component is a push-button tact switch.

7. A multi-way input device according to claim 1, characterized in that said second interlocking member is mounted in the articulation member with a small free play, and in that an operating action on the operating shaft along its general axis does not provoke any rotation of the first interlocking member around the first axis, nor any rotation of the second interlocking member around the second axis.

* * * * *